US008564386B2

(12) United States Patent
Moeller et al.

(10) Patent No.: US 8,564,386 B2
(45) Date of Patent: Oct. 22, 2013

(54) ELECTRICAL SWITCHING DEVICE

(75) Inventors: Matthew Len Moeller, Rock Falls, IL (US); Kurt Thomas Zarbock, Advance, NC (US); Victor Eugene Slack, Lewisville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 227 days.

(21) Appl. No.: 13/008,700

(22) Filed: Jan. 18, 2011

(65) Prior Publication Data

US 2012/0182097 A1 Jul. 19, 2012

(51) Int. Cl.
*H01H 51/22* (2006.01)

(52) U.S. Cl.
USPC ..... 335/78; 335/132

(58) Field of Classification Search
USPC ..... 335/78
See application file for complete search history.

(56) References Cited

U.S. PATENT DOCUMENTS

| | | | | |
|---|---|---|---|---|
| 3,348,176 | A | 10/1967 | Gullett | |
| 4,216,452 | A | 8/1980 | Arnoux et al. | |
| 4,388,535 | A | 6/1983 | Wiktor et al. | |
| 4,430,579 | A | 2/1984 | Wiktor | |
| 4,490,701 | A | 12/1984 | Dietrich et al. | |
| 4,529,953 | A | 7/1985 | Myers | |
| 4,562,418 | A | 12/1985 | Bachler | |
| 4,833,435 | A * | 5/1989 | Ohara | 335/265 |
| 4,922,216 | A | 5/1990 | Dietrich | |
| 5,122,770 | A | 6/1992 | Held | |
| 5,568,108 | A | 10/1996 | Kirsch | |
| 5,684,442 | A | 11/1997 | Hufschmid | |
| 5,694,099 | A | 12/1997 | Connell et al. | |
| 5,945,900 | A | 8/1999 | Shibata et al. | |
| 6,020,801 | A | 2/2000 | Passow | |
| 6,046,660 | A | 4/2000 | Gruner | |
| 6,046,661 | A | 4/2000 | Reger et al. | |
| 6,292,075 | B1 | 9/2001 | Connell et al. | |

(Continued)

FOREIGN PATENT DOCUMENTS

| | | |
|---|---|---|
| DE | 9215688.6 | 1/1993 |
| DE | 102006015815 B3 | 9/2007 |

(Continued)

OTHER PUBLICATIONS

European Search Report, Mail Date Apr. 5, 2012, Application No. 12151169.5-2214.

*Primary Examiner* — Elvin G Enad
*Assistant Examiner* — Lisa Homza

(57) ABSTRACT

An electrical switching device includes a switch housing and first and second circuit assemblies received in the switch housing. Each of the first and second circuit assemblies include a base terminal and a moveable terminal moveable between an open state and a closed state. The moveable terminal is electrically connected to the base terminal in the closed state. An actuator assembly is received in the switch housing. The actuator assembly includes a motor that has a drive coil generating a magnetic field. First and second pivots are arranged within the magnetic field of the drive coil. The first and second pivots are rotated when the drive coil is operated. First and second actuators are coupled to the first and second pivots and are slidable within the switch housing. The first and second actuators are operatively coupled to the moveable terminals of the first and second circuit assemblies, respectively. The first and second actuators move the moveable terminals between the open and closed states.

20 Claims, 3 Drawing Sheets

(56) References Cited

U.S. PATENT DOCUMENTS

| | | | | |
|---|---|---|---|---|
| 6,320,485 | B1 | 11/2001 | Gruner | |
| 6,538,540 | B2 * | 3/2003 | Oberndorfer et al. | 335/78 |
| 6,563,409 | B2 | 5/2003 | Gruner | |
| 6,621,393 | B2 | 9/2003 | Comtois et al. | |
| 6,628,184 | B1 | 9/2003 | Cassagrande et al. | |
| 6,816,353 | B2 | 11/2004 | Mani et al. | |
| 7,049,932 | B2 | 5/2006 | French et al. | |
| 7,504,915 | B2 | 3/2009 | Takayama et al. | |
| 8,203,403 | B2 | 6/2012 | Moeller et al. | |
| 2009/0033446 | A1 | 2/2009 | Gruner et al. | |
| 2009/0033447 | A1 | 2/2009 | Gruner et al. | |

FOREIGN PATENT DOCUMENTS

| | | | |
|---|---|---|---|
| EP | 1174897 | A2 | 1/2002 |
| EP | 1732099 | A2 | 12/2006 |
| EP | 1843377 | | 10/2007 |
| EP | 1968083 | | 9/2008 |
| WO | 03049129 | | 6/2003 |
| WO | 2005106907 | | 11/2005 |
| WO | 2006024855 | | 3/2006 |
| WO | 2006035235 | | 4/2006 |
| WO | 2007012883 | | 2/2007 |

* cited by examiner

ELECTRICAL SWITCHING DEVICE

CROSS REFERENCE TO RELATED APPLICATIONS

This application relates to U.S. patent application Ser. No. 12/549,176 filed Aug. 27, 2009, the subject matter of which is herein incorporated by reference in its entirety.

BACKGROUND OF THE INVENTION

The subject matter herein relates generally to electrical switching devices that are configured to control the flow of an electrical current therethrough.

Electrical switching devices (e.g., contactors, relays) exist today for connecting or disconnecting a power supply to an electrical device or system. For example, an electrical switching device may be used in an electrical meter that monitors power usage by a home or building. Conventional electrical devices include a housing that receives a plurality of output and input terminals and a mechanism for electrically connecting the output and input terminals. Typically, one of the terminals includes a spring arm that is moveable between an open position and a closed position to electrically connect the output and input terminals. In some switching devices, a solenoid actuator is operatively coupled to the spring arm to move the spring arm between the open and closed positions. When the solenoid actuator is triggered or activated, the solenoid actuator generates a predetermined magnetic field that is configured to move the spring arm to establish an electrical connection. The solenoid actuator may also be activated to generate an opposite magnetic field to move the spring arm to disconnect the output and input terminals.

However, a switching device that uses a solenoid actuator as described above is not without disadvantages. For example, the solenoid actuators include a pivot member that actuates multiple spring arms simultaneously. The force required to actuate the spring arms is relatively high and additive because the pivot member is moving multiple spring arms. The solenoid actuator is designed to achieve such force, and the drive coil is sized appropriately to actuate the pivot. Having the drive coil sized larger to overcome the larger force of actuating multiple spring arms requires a larger drive coil, and thus more copper windings for the drive coil, which increases the cost of the drive coil.

Furthermore, switching devices are typically designed with the spring arm being positioned between, and parallel to, stationary blades that form the circuit assemblies of the switching devices. The current tends to travel in a first direction along one stationary blade, in a second direction along the spring arm, and then back in the first direction along the other stationary blade. The current traveling in opposite directions down one of the stationary blades creates a magnetic field and force on the spring arm in a direction that tends to close the spring arm. However, the current traveling down the other stationary blade creates a magnetic field and force on the spring arm in the opposite direction that tends to open the spring arm. These force counteract one another, and the opening force tends to negate the advantage received from the closing force. Additionally, the layering of the stationary blades and spring arm tends to create a long current path through the switching device, which increases the heat generated by the terminals, in some situations to unacceptable levels.

Accordingly, there is a need for electrical switching devices that simplify and reduce the cost of the switching device. There is a need for a switching device that meets temperature rise and short circuit requirements of the industry.

BRIEF DESCRIPTION OF THE INVENTION

In one embodiment, an electrical switching device is provided having a switch housing. First and second circuit assemblies are received in the switch housing. Each of the first and second circuit assemblies includes a base terminal and a moveable terminal moveable between an open state and a closed state. The moveable terminal is electrically connected to the base terminal in the closed state. An actuator assembly is received in the switch housing. The actuator assembly includes a motor that has a drive coil generating a magnetic field. First and second pivots are arranged within the magnetic field of the drive coil. The first and second pivots are rotated when the drive coil is operated. First and second actuators are coupled to the first and second pivots and are slidable within the switch housing. The first and second actuators are operatively coupled to the moveable terminals of the first and second circuit assemblies, respectively. The first and second actuators move the moveable terminals between the open and closed states.

In another embodiment, an electrical switching device is provided having a switch housing that has a mid-plane. First and second circuit assemblies are received in the switch housing. The first circuit assembly is positioned on a first side of the mid-plane. The second circuit assembly is positioned on a second side of the mid-plane. Each of the first and second circuit assemblies includes a base terminal and a moveable terminal moveable between an open state and a closed state. The moveable terminal is electrically connected to the base terminal in the closed state. An actuator assembly is received in the switch housing that includes a motor that has a drive coil extending along a coil axis parallel to the mid-plane. First and second pivots are rotated when the drive coil is operated. The first pivot member is positioned on the first side of the mid-plane. The second pivot member is positioned on the second side of the mid-plane. First and second actuators are coupled to the first and second pivots and are slidable within the switch housing by the first and second pivots. The first actuator is positioned on the first side of the mid-plane. The second actuator is positioned on the second side of the mid-plane. The first and second actuators are operatively coupled to the moveable terminals of the first and second circuit assemblies, respectively. The first and second actuators move the moveable terminals between the open and closed states.

DETAILED DESCRIPTION OF THE INVENTION

Figure 1:
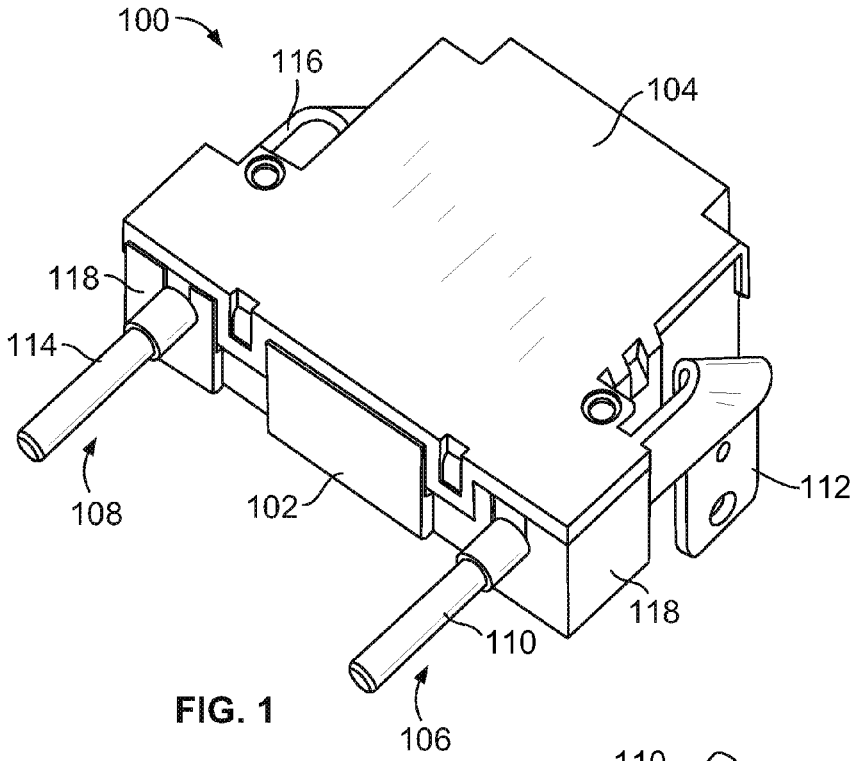
FIG. 1 is a top perspective view of an electrical switching device formed in accordance with an exemplary embodiment.

FIG. 1 is a top perspective view of an electrical switching device 100 formed in accordance with an exemplary embodiment. The switching device 100 includes a switch housing 102 and a cover 104 coupled to the switch housing 102. The switching device 100 is configured to receive and enclose at least one circuit assembly (shown as a pair of circuit assemblies 106 and 108). The circuit assemblies 106, 108 may also be referred to as poles.

The switching device 100 is configured to selectively control the flow of current through the circuit assemblies 106, 108. By way of one example, the switching device 100 may be used with an electrical meter of an electrical system for a home or building. For example, the switching device 100 is designed to be fitted within a domestic electrical utility meter casing for isolating the main utility power feed from the domestic loads in the house or building. The switching device 100 is configured to safely withstand reasonable short circuit faults on the load side of the meter.

The circuit assembly 106 includes output and input terminals 110 and 112. The circuit assembly 108 includes output and input terminals 114 and 116. The output and input terminals 110, 112 electrically connect to each other within the switch housing 102, and the output and input terminals 114, 116 electrically connect to each other within the switch housing 102. In the illustrated embodiment, the output terminals 110, 114 constitute posts extending from the switch housing 102. The input terminals 112, 116 constitute blade terminals extending from the switch housing 102. Other types of terminals may be used in alternative embodiments. The output terminals 110, 114 receive an electrical current $I_i$ from a remote power supply, such as a transformer, and the input terminals 112, 116 deliver the current $I_o$ to an electrical device or system. Current enters the switch housing 102 through the input terminals 112, 116 and exits the switch housing 102 through the output terminals 110, 114. The switching device 100 may disconnect the circuit assemblies 106, 108 such that no current flows to the input terminals 112, 116.

In the illustrated embodiment, the output terminals 110, 114 are received into the switch housing 102 through a common side, such as a front of the switch housing 102, and the input terminals 112, 116 are received into the switch housing 102 through a common side, such as a rear of the switch housing 102, that is different than the side that receives the output terminals 110, 114. The switch housing 102 includes blocks 118 on opposite sides of the switch housing 102, with the output and input terminals 110, 112 of the first circuit assembly 106 extending from the block 118 on one side of the switch housing 102 and the output and input terminals 114, 116 of the second circuit assembly 108 extending from the block 118 on the other side of the switch housing 102. However, other configurations of the terminals are possible in alternative embodiments, such as all the terminals 110, 112, 114, 116 entering the switch housing 102 through a common side, each of the terminals 110, 112, 114, 116 entering through different sides, or other combinations.

Figure 2:
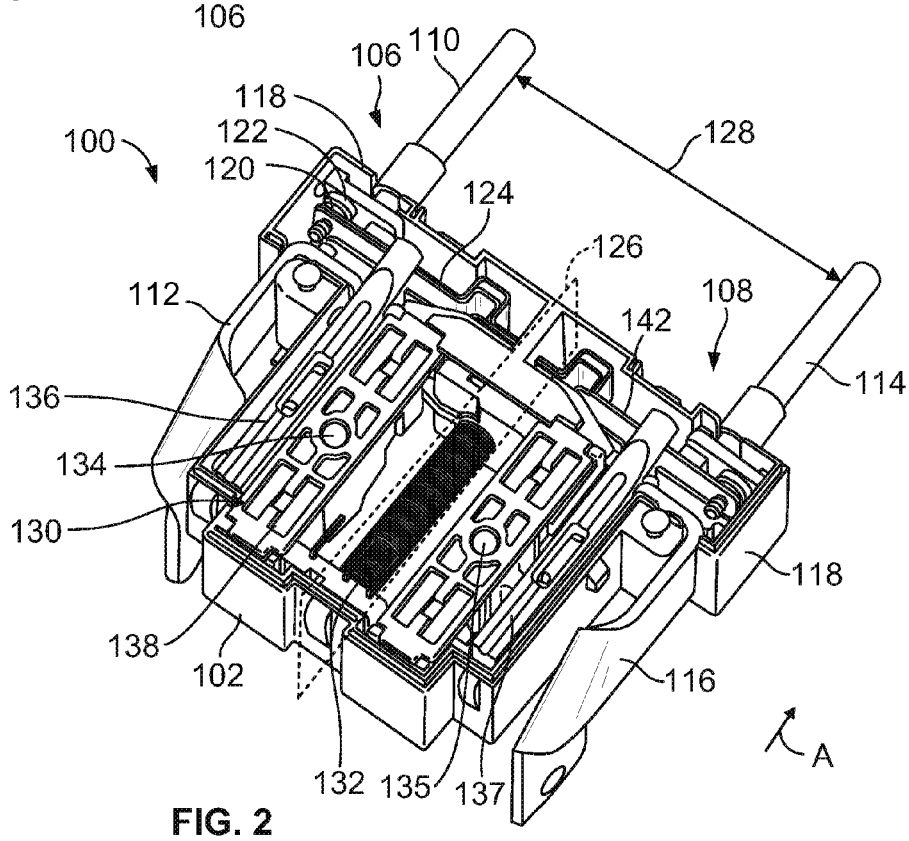
FIG. 2 is a top perspective view of the electrical switching device shown in FIG. 1, with a cover thereof removed illustrating internal components of the electrical switching device.

FIG. 2 is a top perspective view of the switching device 100 with the cover 104 removed for clarity. In order to avoid unnecessary repetition of references in the drawings, only the left-hand parts of the switching device 100 (e.g. the parts of the circuit assembly 106) will be generally referred to, it being understood that the right-hand parts of the switching device 100 (e.g. the parts of the circuit assembly 108) are essentially similar.

The circuit assembly 106 includes the output and input terminals 110, 112. The output and input terminals 110, 112 electrically connect to each other within the switch housing 102 through mating contacts 120 and 122. In the illustrated embodiment, the input terminal 112 may be referred to as a base terminal 112 since the input terminal 112 remains generally fixed in position within the switch housing 102. The output terminal 110 may be referred to as a moveable terminal 110 since the output terminal 110 may be moved to and from the input terminal 112 during operation to connect and disconnect the moveable terminal 110 with the base terminal 112. However, in other embodiments, the output terminal 110 may be a base terminal and the input terminal 112 may be a moveable terminal.

The base terminal 112 includes a stationary blade that is held within the switch housing 102 in a fixed position. The stationary blade is relatively short and maintained within the block 118. The stationary blade does not extend into the main part of the switch housing 102. The stationary blade is short, which reduces the length of the current path of the first circuit assembly 106 within the switch housing 102. Having a shorter current path reduces the resistance of the terminals of the first circuit assembly 106, which may reduce the temperature of the terminals. The mating contact 122 is provided proximate to an end of the blade. The base terminal includes a post coupled to the stationary blade, generally at the end of the blade opposite the mating contact 122. The post extends perpendicular from the stationary blade out of the switch housing 102. The post may be loaded into another electrical device, such as a transformer or utility meter.

The moveable terminal 110 includes a stationary blade that is held within the switch housing 102 in a fixed position. The stationary blade extends through the switch housing 102 and is provided both inside and outside of the switch housing 102. One or more spring blades or spring arms 124 are electrically coupled to an end of the blade. The spring arms 124 may be similar to the spring blades described in U.S. patent application Ser. No. 12/549,176, the subject matter of which is herein incorporated by reference in its entirety. The spring arms 124 may be stamped springs that are manufactured from a material that is conductive to allow current to flow between the blade of the base terminal 112 and the blade of the moveable terminal 110. The spring arm 124 is sufficiently flexible to allow the spring arm 124 to move between the open and closed positions. The spring arms 124 are split and extend along bifurcated paths, which may increase the flexibility of the spring arms 124. Alternatively, a single spring arm 124 may be provided.

The mating contact 120 is provided proximate to an end of each spring arm 124 generally opposite the connection with the blade. The spring arm 124 is the moveable part of the moveable terminal 110. The spring arm 124 is moveable between an open position and a closed position. In the closed position, the mating contact 120 is connected to, and engages, the mating contact 122 and current flows through the circuit assembly 106. In the open position, the mating contact 120 is disconnected from, and spaced apart from, the mating contact 122 such that current is unable to flow through the circuit assembly 106.

In the illustrated embodiment, the end of the stationary blade outside of the switch housing 102 is turned downward, however such end may be turned upward or extend straight outward from the switch housing 102. Another terminal may be electrically coupled to the end of the stationary blade outside of the switch housing 102. For example, the downward part may be a separate terminal coupled to the moveable terminal 110. The moveable terminal 114 and/or the base terminal 116 may be or include a post rather than or in addition to the stationary blade.

In an exemplary embodiment, the switch housing 102 has a mid-plane 126. The mid-plane 126 is generally perpendicular to the top and bottom of the switch housing 102. The mid-plane 126 is generally perpendicular to the front and the rear of the switch housing 102. The mid-plane 126 is located between the opposite sides of the switch housing 102. The mid-plane 126 is located between the blocks 118 on the opposite sides of the switch housing 102. The mid-plane 126 may be substantially centrally located between the opposite sides. Optionally, the switch housing 102 may be mirrored on the right and left hand sides of the mid-plane 126. Alternatively, the switch housing 102 on the right hand side may have a different shape and/or different features than on the left hand side of the mid-plane 126.

The circuit assembly 106 is provided on the left-hand side of the mid-plane 126, while the circuit assembly 108 is provided on the right-hand side of the mid-plane 126. In an exemplary embodiment, the circuit assemblies 106, 108 are mirrored across the mid-plane 126, with the various components of the first circuit assembly 106 aligned with the similar components of the second circuit assembly 108 across the mid-plane 126. The various components of the first circuit assembly 106 may be spaced a similar distance away from the mid-plane 126 as the similar components of the second circuit assembly 108.

In an exemplary embodiment, the portions of the output and input terminals 110, 112 outside of the switch housing 102 are generally parallel to one another and parallel to the mid-plane 126. The portions of the output and input terminals 110, 112 outside of the switch housing 102 are spaced apart by a spacing 128. The spring arms 124 are oriented generally perpendicular with respect to the portions of the output and input terminals 110, 112 outside of the switch housing 102. The spring arm 124 extends inward toward the mid-plane 126 and a majority of the length of the spring arm 124 is beyond an inner surface of the input terminal 112. As such, the currents in the input terminal 112 do not create a force tending to open the terminals 110, 112, as would be the case if the input terminal 112 extended parallel to the spring arm 124. The spring arm 124 is arranged side-by-side with the a portion of the stationary blade of the moveable terminal 110 allowing current therein to create opposing forces to hold the spring arm 124 in the closed state, such as to resist blow out during high load or a short circuit fault event.

The switching device 100 is configured to selectively control the flow of current through the switch housing 102. Current enters the switch housing 102 through the input terminals 112, 116 and exits the switch housing 102 through the output terminals 110, 114. In an exemplary embodiment, the switching device 100 is configured to simultaneously connect or disconnect the terminals 110, 112 and the terminals 114, 116. The switching device 100 includes an actuator assembly 130 that simultaneously connects or disconnects the terminals 110, 112 and the terminals 114, 116. The actuator assembly 130 is provided in the spacing 128 between the circuit assemblies 106, 108. The actuator assembly 130 is provided at the mid-plane 126. Optionally, the actuator assembly 130 may be centered along the mid-plane 126.

The actuator assembly 130 includes an electromechanical motor 132, first and second pivot members 134, 135 operated by the motor 132 and first and second actuators 136, 137 moved by the first and second pivot members 134, 135, respectively. Pivot stabilizers 138, 139 are held by the switch housing 102 to hold the pivot members 134, 135 within the switch housing 102.

The pivot members 134, 135 are rotatable within the switch housing 102 between first rotated positions and second rotated positions. The motor 132 controls the position of the pivot members 134, 135, such as by changing a polarity of a magnetic field generated by the motor 132.

The actuators 136, 137 are slidable in a linear direction within the switch housing 102 between first positions and second positions, such as in the direction of arrow A. The pivot members 134, 135 control the positions of the actuators 136, 137. For example, the first rotated positions may correspond with the first positions of the actuator 136, 137. The second rotated positions may correspond with the second positions of the actuators 136, 137. The actuator 136 is coupled to the spring arms 124 of the first circuit assembly 106. The actuator 137 is coupled to spring arms 142 of the output terminal 114 of the second circuit assembly 108. The actuators 136, 137 move the spring arms 124, 142 between opened and closed positions to connect or disconnect the terminals 110, 112 and the terminals 114, 116.

In some embodiments, the actuator assembly 130 may include compression springs similar to the compression springs described in U.S. Patent Application titled "ELECTRICAL SWITCHING DEVICE", filed concurrently herewith, the complete subject matter of which is herein incorporated by reference in its entirety. Alternatively, the spring arms 124, 142 may include springs to maintain contact pressure against the input terminals 112, 116 similar to the springs described in U.S. patent application Ser. No. 12/549,176, the subject matter of which is herein incorporated by reference in its entirety.

In some embodiments, the switching device 100 is communicatively coupled to a remote controller (not shown). The remote controller may communicate instructions to the switching device 100. The instructions may include operating commands for activating or inactivating the motor 132. In addition, the instructions may include requests for data regarding usage or a status of the switching device 100 or usage of electricity.

Figure 3:
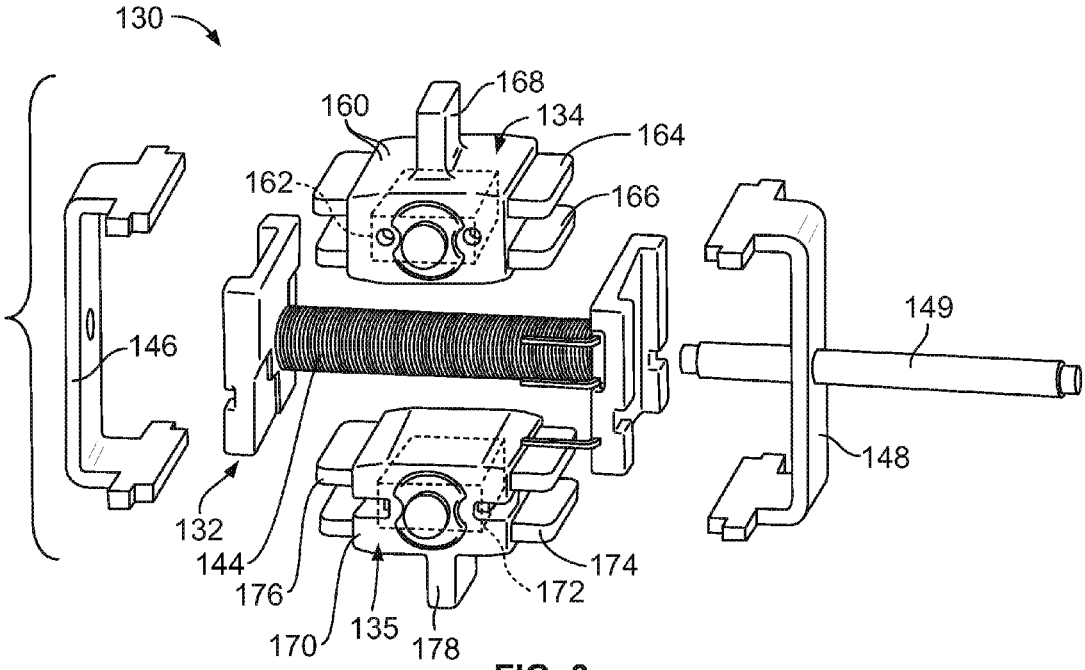
FIG. 3 is an exploded view of an actuator assembly for the electrical switching device shown in FIG. 1.

FIG. 3 is an exploded view of the actuator assembly 130 without the actuators 136, 137 (shown in FIG. 2). In the exemplary embodiment, the motor 132 generates a predetermined magnetic flux or field to control the movement of the pivot members 134, 135. For example, the motor 132 may be a solenoid actuator. The motor 132 includes a drive coil 144 and a pair of yokes 146, 148 connected by a rod 149. The yokes 146, 148 are configured to magnetically couple to the pivot members 134, 135 to control rotation of the pivot members 134, 135. When the drive coil 144 is activated, a magnetic field is generated and the pivot members 134, 135 are arranged within the magnetic field. A direction of the field is dependent upon the direction of the current flowing through the drive coil 144. Based upon the direction of the current, the pivot members 134, 135 will move to one of two rotational positions. In an exemplary embodiment, the pivot members 134, 135 are rotated in opposite directions when the drive coil 144 is activated.

The pivot member 134 includes a pivot body 160 that holds a permanent magnet 162 (shown in phantom) and a pair of armatures 164 and 166. The magnet 162 has opposite North and South poles or ends that are each positioned proximate to a corresponding armature 166, 164. The armatures 164 and 166 may be positioned with respect to each other and the magnet 162 to form a predetermined magnetic flux for selectively rotating the pivot member 134. In the illustrated embodiment, the arrangement of the armatures 164 and 166 and the magnet 162 is substantially H-shaped. However, other arrangements of the armatures 164 and 166 and the magnet 162 may be made. A projection or post 168 projects away from an exterior surface of the pivot body 160. The post 168 projects outward away from the drive coil 144.

The pivot member 135 includes a pivot body 170 that holds a permanent magnet 172 (shown in phantom) and a pair of armatures 174 and 176. The magnet 172 has opposite North and South poles or ends that are each positioned proximate to a corresponding armature 176, 174. The armatures 174 and 176 may be positioned with respect to each other and the magnet 172 to form a predetermined magnetic flux for selectively rotating the pivot member 135. In the illustrated embodiment, the arrangement of the armatures 174 and 176 and the magnet 172 is substantially H-shaped. However, other arrangements of the armatures 174 and 176 and the magnet 172 may be made. A projection or post 178 projects away from an exterior surface of the pivot body 170. The post 178 projects outward away from the drive coil 144 in a direction opposite the post 168.

Figure 4:
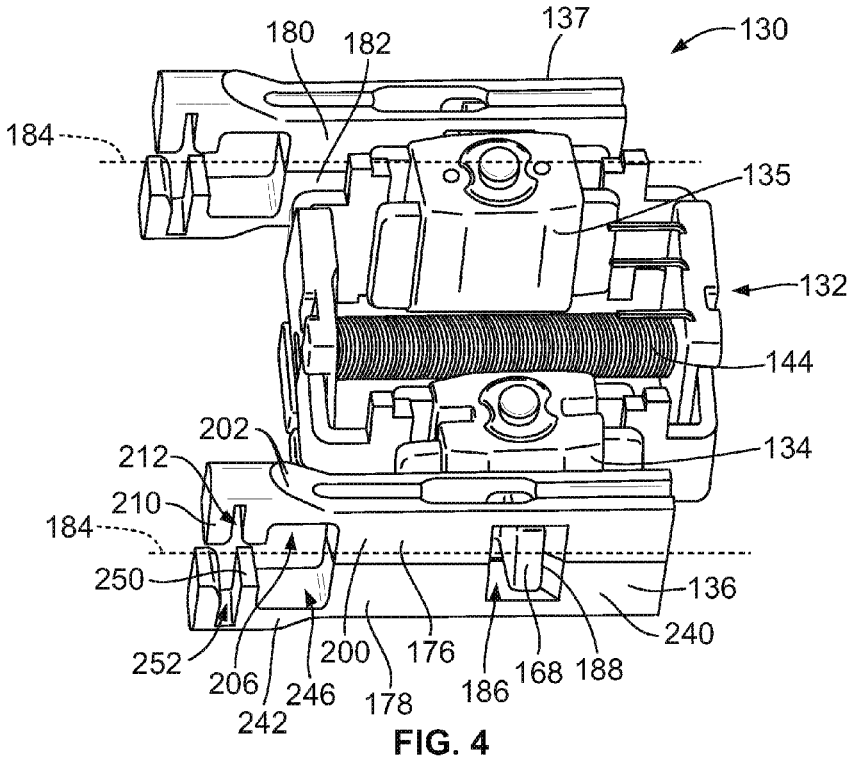
FIG. 4 is a top perspective view of a portion of an actuator for the actuator assembly shown in FIG. 3.

FIG. 4 a side perspective view of the actuator assembly 130 with the actuators 136, 137 coupled to the pivot members 134, 135. The actuator 137 is substantially similar to the actuator 136. In order to avoid unnecessary repetition of references in the drawings, only the actuator 136 will be generally referred to, it being understood that the components of the actuator 137 are essentially similar.

The actuator 136 includes an upper actuator 180 and a lower actuator 182 that are stacked together to form the actuator 136. The upper and lower actuators 180, 182 are independently moveable with respect to one another. Optionally, the upper and lower actuators 180, 182 may be identical to one another. Alternatively, the upper and lower actuators 180, 182 may be different than one another. The actuator 136 extends along a longitudinal axis 184. The actuator 136 is split into the upper and lower actuators 180, 182 along the longitudinal axis 184.

The actuator 136 includes an opening 186 therein. The post 168 is received in the opening 186 defined by walls 188. The post 168 rests along one or more of the walls 188. The post 168 may press against walls 188 to move the actuator 136 when the pivot member 134 is rotated. For example, the post 168 may press the actuator 136 forward as the pivot member 134 is rotated in the second rotational direction, while the post may press the actuator 136 rearward as the pivot member 134 is rotated in the first rotational direction.

In an exemplary embodiment, the magnets 162, 172 (shown in FIG. 3) are arranged within the pivot members 134, 135 such that the pivot members 134, 135 are rotated in opposite directions when the drive coil 144 is activated. For example, the pivot members 134, 135 may be rotated in first rotational directions to move the posts 168, 178 away from the spring arms 124, 142 (shown in FIG. 2) to disconnect the spring arms 124, 142 from the base terminals 110, 114 (shown in FIG. 2). In the view shown in FIG. 4, the pivot member 134 is rotated in a counterclockwise direction to define the first rotational direction of the pivot member 134, while the pivot member 135 is rotated in a clockwise direction to define the first rotational direction of the pivot member 135. The pivot members 134, 135 may be rotated in second rotational directions to move the posts 168, 178 toward the spring arms 124, 142 to connect the spring arms 124, 142 to the base terminals 110, 114. In the view shown in FIG. 4, the pivot member 134 is rotated in a clockwise direction to define the second rotational direction of the pivot member 134, while the pivot member 135 is rotated in a counterclockwise direction to define the second rotational direction of the pivot member 135.

The upper actuator 180 includes a main body 200 extending along the longitudinal axis 184. The opening 186 is provided in the main body 200. The upper actuator 180 includes an arm 202 extending from the main body 200 in a forward direction. The arm 202 extends over a channel 206. The channel 206 is configured to receive portions of the switch housing 102 (shown in FIG. 2) and/or portions of the circuit assembly 106 (shown in FIG. 2), such as the stationary blade of the moveable terminal 112 (shown in FIG. 2).

The arm 202 includes fingers 210 extending downward therefrom at a distal end of the arm 202. A slot 212 is defined between the fingers 210. The slot 212 receives the spring arm 124 (shown in FIG. 2). The spring arm 124 is captured between the fingers 210 within the slot 212. As the upper actuator 180 is moved between the first position and the second position, one or the other finger 210 engages the spring arm 124 to move the spring arm 124 between the open and closed positions. The slot 212 is oriented generally perpendicular to the longitudinal axis 184.

The lower actuator 182 includes a main body 240 extending along the longitudinal axis 184. The opening 186 is provided in the main body 240. The lower actuator 182 includes an arm 242 extending from the main body 240 in a forward direction. The arm 242 extends over a channel 246. The channel 246 receives portions of the switch housing 102 (shown in FIG. 2) and/or portions of the circuit assemblies 106, such as the stationary blade of the moveable terminal 112. The channel 246 is aligned with the channel 206 of the upper actuator 180.

The arm 242 includes fingers 250 extending upward therefrom at a distal end of the arm 242. A slot 252 is defined between the fingers 250. The fingers 250 and slot 252 are aligned with the fingers 210 and slot 212 of the upper actuator 180. The slot 252 receives the spring arm 124 (shown in FIG. 2). The spring arm 124 is captured between the fingers 250 within the slot 252. As the lower actuator 182 is moved between the first position and the second position, one or the other finger 250 engages the spring arm 124 to move the spring arm 124 between the open and closed positions. The slot 252 is oriented generally perpendicular to the longitudinal axis 184.

The actuator 137 is substantially similar to the actuator 136. The actuators 136, 137 extend parallel to one another. The actuators 136, 137 are arranged on opposite sides of the motor 132. In an exemplary embodiment, when the motor 132 is activated, the pivot members 134, 135 are simultaneously moved. The actuators 136, 137 are moved in common directions, such as both being moved forward (e.g. toward the spring arms 124, 142) or both being moved rearward (e.g. away from the spring arms 124, 142).

Figure 5:
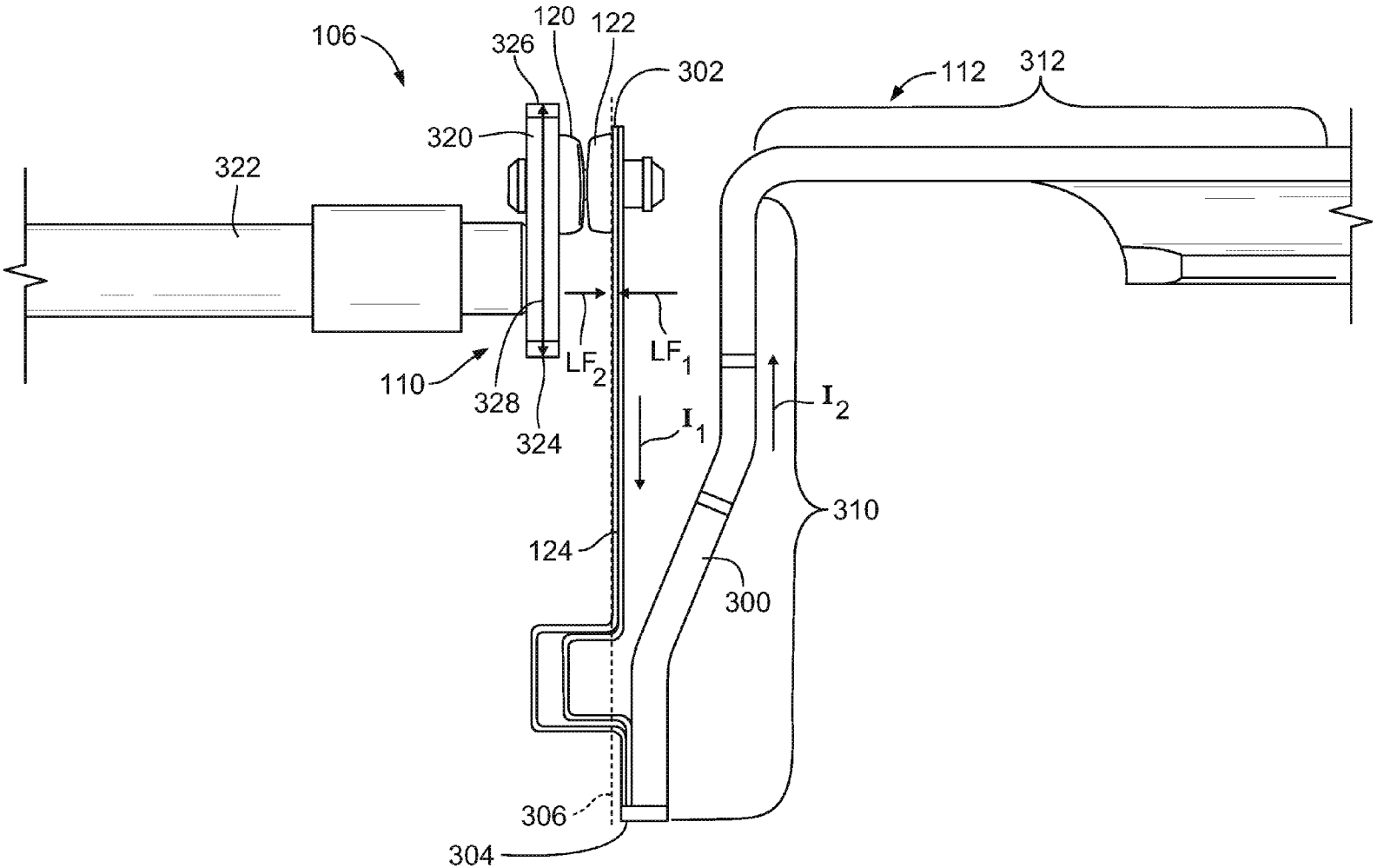
FIG. 5 is a top view of another portion of the actuator for the actuator assembly shown in FIG. 3.

FIG. 5 is a plan view of current flowing through the circuit assembly 106 of the switching device 100 (shown in FIG. 1). In the exemplary embodiment, the moveable terminal 112 utilizes Lorentz forces (also called Ampere's forces) to facilitate maintaining the connection between the mating contacts 120 and 122. More specifically, the moveable terminal 112 includes the spring arm 124 and a stationary blade 300. The spring arm 124 and a stationary blade 300 are arranged with respect to each other such that the current $I_1$ extending through the spring arm 124 is flowing in an opposite direction with respect to the current $I_2$ flowing through the stationary blade 300. As such, magnetic fields generated by the spring arm 124 and a stationary blade 300 force the spring arm 124 away from the stationary blade 300 and push the spring arms 124 toward the base terminal 110. The Lorentz force, indicated as $LF_1$, may facilitate maintaining the electrical connection between the mating contacts 120 and 122 during a high current fault.

The spring arm 124 extends between a first end 302 and a second end 304. The spring arm 124 generally extends along an arm axis 306 between the first and second ends 302, 304. The mating contact 122 is provided proximate to the first end 302. The spring arm 124 is terminated to the stationary blade 300 proximate to the second end 304.

The stationary blade 300 includes a first segment 310 and a second segment 312 extending generally perpendicular to the first segment 310. The first segment 310 is generally the portion of the stationary blade 300 that is retained inside the switch housing 102 (shown in FIG. 2), while the second segment 312 is generally the portion of the stationary blade 300 that is positioned outside the switch housing 102. The first segment 310 extends generally parallel to the spring arm 124. The second segment 312 extends generally perpendicular to the spring arm 124.

The spring arm 124 and the first segment 310 overlap for substantially the entire lengths thereof. The amount of overlap affects the Lorentz force $LF_1$. The Lorentz force $LF_1$ is thus affected by the lengths of the spring arm 124 and the first segment 310.

The base terminal 110 includes a stationary blade 320 and a post 322 extending from the stationary blade 320. The stationary blade 320 is generally the portion of the base terminal 110 that is retained inside the switch housing 102, while the post 322 is generally the portion of the base terminal 110 that is positioned outside the switch housing 102. The stationary blade 320 extends generally parallel to the spring arm 124 and holds the mating contact 120. The post 322 extends generally perpendicular to the spring arm 124.

The stationary blade 320 extends between an inner surface 324 and an outer surface 326. The stationary blade 320 has a length 328 between the inner and outer surfaces 324, 326. The stationary blade 320 overlaps with the spring arm 124 along substantially the entire length 328. Lorentz forces also affect the interaction between the stationary blade 320 and the spring arm 124. The Lorentz forces may have a negative impact on the connection between the moveable terminal 112 and the base terminal 110. For example, the Lorentz forces $LF_2$ may tend to push the spring arm 124 away from the stationary blade 320, forcing the spring arm 124 to the open position. The current $I_1$ extending through the spring arm 124 is flowing in an opposite direction with respect to the current $I_3$ flowing through the stationary blade 320. As such, magnetic fields generated by the spring arm 124 and the stationary blade 320 force the spring arm 124 away from the stationary blade 320 and push the spring arm 124 open. Having the length 328 relatively short, as compared to the overall length of the spring arm 124, reduces the amount of the force $LF_2$. Additionally, having the length 328 relatively short reduces the total current path of the circuit assembly 106, which reduces the total heat generated by the terminals of the circuit assembly 106.

Furthermore, the above-described embodiments (and/or aspects thereof) may be used in combination with each other. In addition, many modifications may be made to adapt a particular situation or material to the teachings of the invention without departing from its scope. While the specific components and processes described herein are intended to define the parameters of the various embodiments of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical switching device comprising:

a switch housing;

first and second circuit assemblies received in the switch housing, each of the first and second circuit assemblies comprising a base terminal and a moveable terminal moveable between an open state and a closed state, the moveable terminal being electrically connected to the base terminal in the closed state; and an actuator assembly received in the switch housing, the actuator assembly comprising:

a motor having a drive coil generating a magnetic field, the drive coil extending along a coil axis;

first and second pivot members arranged within the magnetic field of the drive coil, the first and second pivot members being rotated when the drive coil is operated;

first and second actuators coupled to the first and second pivot members, the first and second actuators being slidable within the switch housing in sliding directions generally parallel to the coil axis, the first and second actuators being operatively coupled to the moveable terminals of the first and second circuit assemblies, respectively, the first and second actuators moving the moveable terminals between the open and closed states.

2. The switching device of claim 1, wherein the first and second pivot members are simultaneously operated by the motor.

3. The switching device of claim 1, the first pivot member and the first actuator being located on a first side of the coil axis, the second pivot member and the second actuator being located on a second side of the coil axis.

4. The switching device of claim 1, wherein the moveable terminals includes spring arms having mating contacts at ends thereof, the mating contacts engaging corresponding mating contacts of the base terminals in the closed positions, the first and second actuators engaging the spring arms of corresponding moveable terminals to move the spring arms between opened and closed positions.

5. The switching device of claim 1, wherein the first and second pivot members are rotated to drive the first and second actuator in a common direction, the first and second actuators being translated in generally parallel linear sliding directions.

6. The switching device of claim 1, wherein the first and second actuators are parallel to one another and spaced apart by a spacing, the motor being positioned in the spacing, the first and second pivot members driving the first and second actuators in parallel sliding directions.

7. The switching device of claim 1, wherein the switch housing has a mid-plane, the coil axis being parallel to the mid-plane, the first and second actuators being slidable along longitudinal axes of the first and second actuators that are parallel to the mid-plane.

8. The switching device of claim 1, wherein the switch housing has a mid-plane, the coil axis being parallel to the mid-plane, the first and second pivot members being rotated about pivot axes parallel to the mid-plane.

9. The switching device of claim 1, wherein the moveable terminals have spring arms and blade portions, the spring arms being terminated to the blade portions, the spring arms extending a length between a first end and a second end, the blade portions extending generally parallel to the spring arms along substantially the entire length, each base terminal extending generally perpendicular with respect to the corresponding spring arms.

10. The switching device of claim 1, wherein the switch housing includes a mid-plane, the moveable terminals of the first and second circuit assemblies being aligned with one another on opposite sides of the mid-plane.

11. The switching device of claim 1, wherein the switch housing includes a mid-plane, the first and second circuit assemblies being mirrored on opposites sides of the mid-plane.

12. The switching device of claim 1, wherein the moveable terminals each include a pair of spring arms, the first actuator engaging both spring arms of the movable terminal of the first circuit assembly, the second actuator engaging both spring arms of the moveable terminal of the second circuit assembly.

13. The switching device of claim 1, wherein the movable terminals have springs arms and stationary blade portions, the spring arms and corresponding stationary blade portions being arranged side by side allowing current therein to create an opposing force to hold the spring arms in the closed state.

14. An electrical switching device comprising:

a switch housing having a mid-plane;

first and second circuit assemblies received in the switch housing, the first circuit assembly positioned on a first side of the mid-plane, the second circuit assembly positioned on a second side of the mid-plane, each of the first and second circuit assemblies comprising a base terminal and a moveable terminal moveable between an open state and a closed state, the moveable terminal being electrically connected to the base terminal in the closed state; and an actuator assembly received in the switch housing, the actuator assembly comprising:

a motor having a drive coil extending along a coil axis parallel to the mid-plane;

first and second pivot members being rotated when the drive coil is operated, the first pivot member positioned on the first side of the mid-plane, the second pivot member positioned on the second side of the mid-plane;

first and second actuators coupled to the first and second pivot members and being slidable within the switch housing by the first and second pivot members, the first and second actuators being moved by the first and second pivot members in sliding directions generally parallel to the mid-plane, the first actuator positioned on the first side of the mid-plane, the second actuator positioned on the second side of the mid-plane, the first and second actuators being operatively coupled to the moveable terminals of the first and second circuit assemblies, respectively, the first and second actuators moving the moveable terminals between the open and closed states.

15. The switching device of claim 14, wherein the first and second pivot members are simultaneously operated by the motor.

16. The switching device of claim 14, wherein the drive coil extends along a coil axis, the coil axis being generally parallel to the mid-plane, the first and second pivot members being rotated about pivot axes parallel to the mid-plane.

17. The switching device of claim 14, wherein the first and second actuators are parallel to one another and spaced apart by a spacing, the motor being positioned in the spacing, the first and second pivot members driving the first and second actuators in parallel sliding directions.

18. The switching device of claim 14, wherein the moveable terminals have spring arms and blade portions, the spring arms being terminated to the blade portions, the spring arms extending a length between a first end and a second end, the blade portion extending generally parallel to the spring arm along substantially the entire length, the base terminal extending generally perpendicular with respect to the spring arm.

19. The switching device of claim 14, wherein moveable terminals of the first and second circuit assemblies are aligned with one another on opposite sides of the mid-plane.

20. The switching device of claim 14, wherein the first and second circuit assemblies are mirrored on opposites sides of the mid-plane.

* * * * *